United States Patent [19]

Reed

[11] Patent Number: 4,757,592

[45] Date of Patent: Jul. 19, 1988

[54] METHOD OF ERECTING A PORTABLE DRILLING RIG

[75] Inventor: Lowell M. Reed, Moore, Okla. 73165

[73] Assignee: Parco Mast and Substructures, Inc., Del City, Okla.

[21] Appl. No.: 904,608

[22] Filed: Sep. 8, 1986

[51] Int. Cl.[4] ..... B21D 39/00

[52] U.S. Cl. ..... 29/429; 29/559; 52/123.1; 166/75.1

[58] Field of Search ..... 29/429, 431, 428, 559; 52/115, 116, 120, 121, 123.1, 125.2, 141, 292, 637; 166/75.1, 77.5, 96; 173/23, 28, 39; 175/57, 85, 318, 392

[56] References Cited

U.S. PATENT DOCUMENTS

| | | | |
|---|---|---|---|
| 3,053,398 | 9/1962 | Liebherr et al. | 52/115 X |
| 3,185,265 | 5/1965 | White | 52/123.1 X |
| 3,213,575 | 10/1965 | Boczek | 52/123.1 |
| 3,365,008 | 1/1968 | Zimmerman et al. | 175/85 |
| 3,494,593 | 2/1970 | Blagg | 52/121 X |
| 3,945,107 | 3/1976 | Houck | 52/123.1 X |

FOREIGN PATENT DOCUMENTS

| | | | |
|---|---|---|---|
| 184947 | 11/1959 | Sweden | 52/123.1 |
| 1133228 | 1/1985 | U.S.S.R. | 52/123.1 |

*Primary Examiner*—Howard N. Goldberg
*Assistant Examiner*—Ronald S. Wallace
*Attorney, Agent, or Firm*—Head & Johnson

[57] ABSTRACT

A jacking crane supported by four telescoping hydraulically powered legs is used to erect a two spaced apart parallel column drilling derrick. Each column is composed of a number of identical column sections which are assembled on site using the jacking crane which is supported in the space between the columns. The two parallel columns are erected by the jacking crane lifting sections one on top of the other. As soon as these newly added sections are secured to the previous sections, the legs of the jack which are supported from column sections are actuated to move the platform of the jack upwardly where it is attached to an upper portion of the partially completed columns and the legs are then released and then raised to a higher point where they are again attached. The crane lifts additional sections and is "walked-up" by stages between the two partially completed columns until the columns reach the desired height.

6 Claims, 6 Drawing Sheets

METHOD OF ERECTING A PORTABLE DRILLING RIG

BACKGROUND OF THE INVENTION

1. Field of the Invention

This relates to a drilling structure for drilling ultra deep holes in the earth.

2. Background of the Prior Art

Holes are drilled in the earth for tapping oil and gas as well as hot water or steam resources. For this purpose derricks are used to support drill pipe, casing and other tubular goods. Most of the derricks are portable and as described in U.S. Pat. No. 4,290,495, issued to Elliston include a collapsible mast which is movable from the reclining transport position to an erect elevated position of use. U.S. Pat. No. 4,269,395, issued to Newman et al is a portable hydraulic rig which has a telescoping mast for telescoping to a reduced length for transportation. Other U.S. patents of interest include: U.S. Pat. Nos. 2,373,319; 3,504,749; 2,840,197; 3,840,198; 2,924,309; and 3,483,933.

Even though these prior art derricks are portable in one sense, they are difficult to transport to remote areas. Further, they are limited in the height which they can be extended.

It is therefore an object of this invention to provide a method of erecting a derrick which is readily portable and which does not have the height limitations most of the present drilling derricks have.

SUMMARY OF THE INVENTION

This relates to a novel drilling rig and a novel method for assembling it. The finished structure is composed of two rectangular columns parallel to each other with no slender ratio and may reach a height of 220 feet or more from the floor to the bottom of the crown. Each column is composed of a plurality of column sections.

Each column section is typically about 8 feet square in cross section and about 12 to 16 feet in height.

A hydraulic jacking crane is spaced between two spaced apart lower column sections which are secured to a substructure. The crane lifts an additional column section and places it on top of the two existing ones. In each column the additional section is then secured to the existing column section by bolts or otherwise. The jacking crane is supported by the partially erected columns. It then lifts itself up in the space between the two partially completed columns. Additional column sections are then added to each of the partially completed columns. This continues until the derrick has reached the desired height. When the two columns are completed, the hydraulic jacking crane is at the top. It remains there for use during the operation of the two spaced apart columns and is used for various utility type work. Then the derrick is ready to be used as a drilling derrick. After the drilling procedures and well completions have been completed, it is usually desired to dismantle the derrick. This is done in just the reverse of the erection of the drilling derrick. The hydraulic jacking crane will jack itself down as it lowers the separated column sections to the ground.

DETAILED DESCRIPTION OF THE PREFERRED EMBODIMENT

Figure 1:
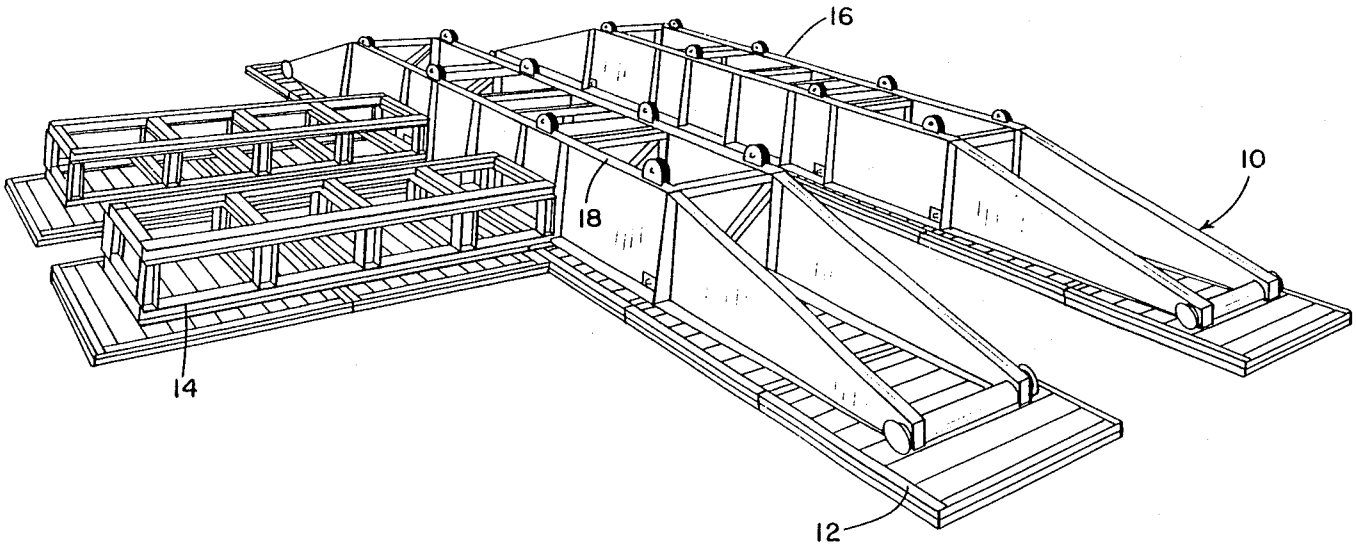
FIG. 1 illustrates an isometric view of the lower sub of a portable drilling rig.

Attention is first directed to FIG. 1 which shows a lower substructure 10 supported upon a matting board 12. Also supported on the matting board 12 is a draw works sub 14. Lower sub 10 has a structure 16 and a second structure 18 upon which the two columns of the portable drilling rig are to be erected.

Figure 2:
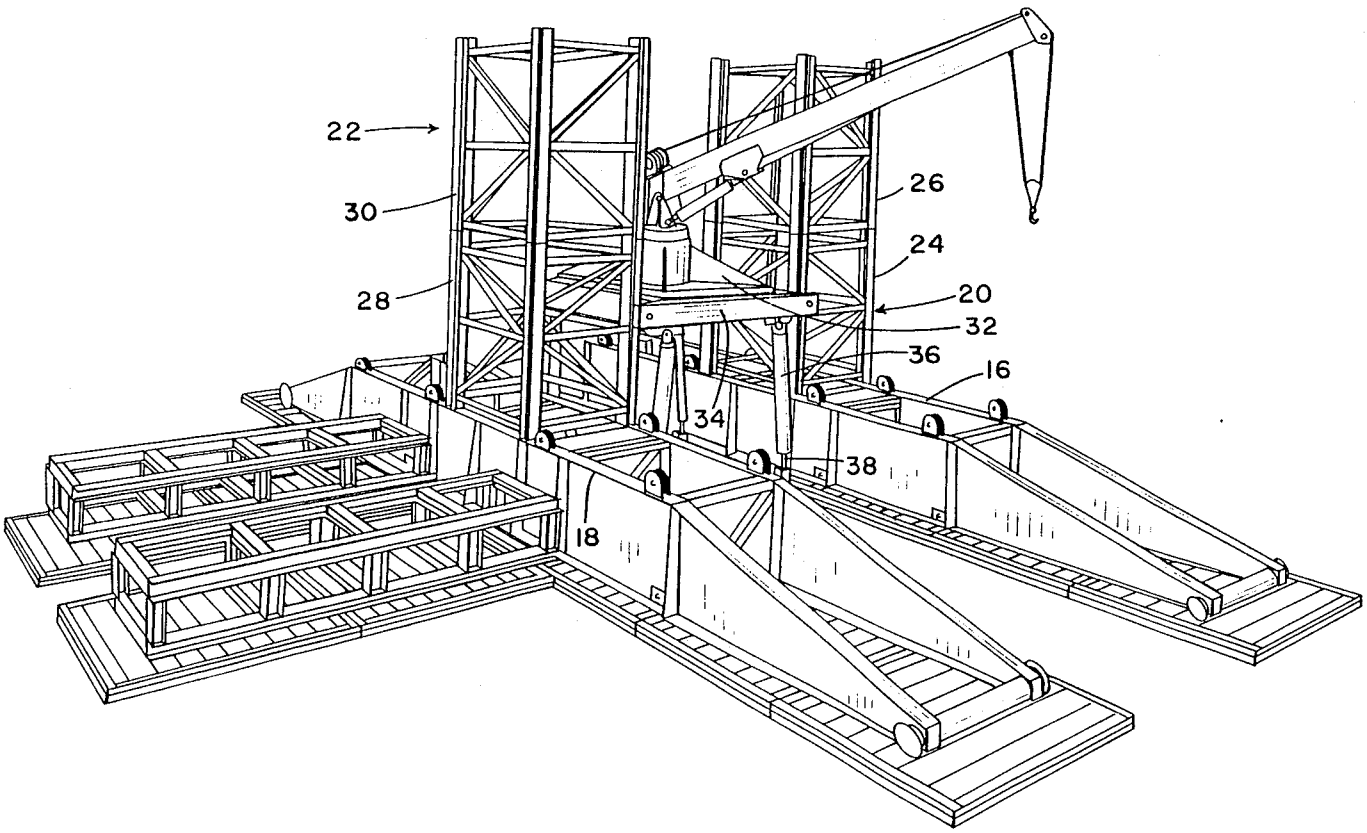
FIG. 2 illustrates the jacking crane in position between two partially erected columns.

Attention is next directed to FIG. 2 which shows a lower column portion on the right and a second lower column portion 22 on the left. Lower column portions 20 and 22 are supported respectively from structures 16 and 18 in any acceptable manner, such as conventionally bolting. Column portion 20 includes a first column section 24 and a second column section 26. Column portion 22 includes a lower column section 28 and an upper column section 30 mounted thereon. The various sections like 30 and 28 can be connected together by any acceptable method such as by bolting. Typically the sections 24, 26, 28 and 30 are 8′ square and 16′ to 24′ high. They may all be identical in size or some may be 16′ and other 24′ high for example. The size of each section will depend largely on the capacity of the transportation means such as a truck or helicopter. Also shown in FIG. 2 is a jacking crane 32 which has a platform for supporting hydraulic cylinders and piston extension 38.

Figure 4:
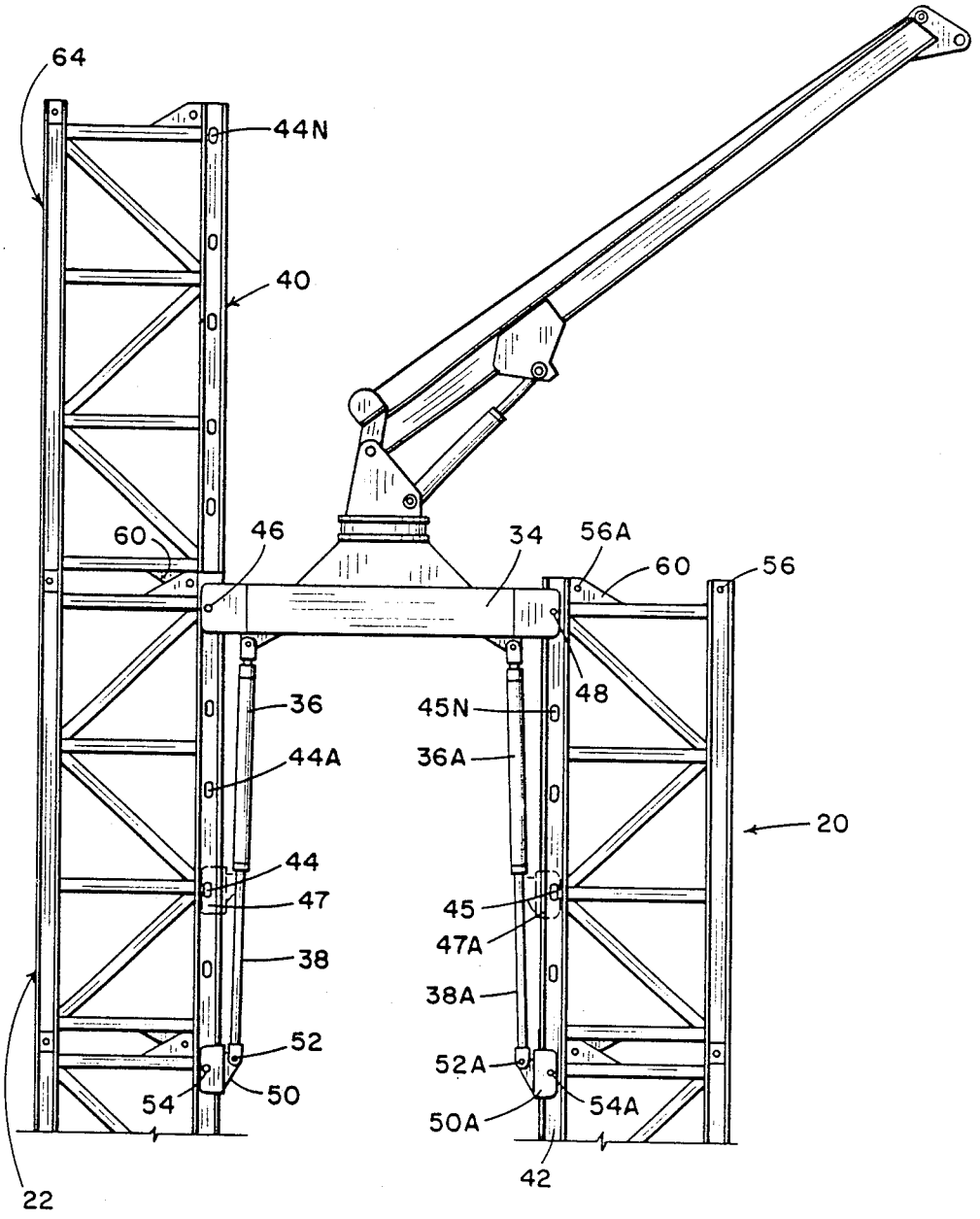
FIG. 4 is a plan view illustrating the positioning of pins in the platform and in the feet of the jacking crane for walking up the space between the columns.

Attention is now directed to FIG. 4 which shows a side view of the jacking crane between partially erected cranes. Shown thereon are column portion 20 and 22. The interior legs 40 and 42 of the column portions serve as guide for the jacking crane. Leg 40 has a plurality of pin holes 44A and 44N and leg 42 has a plurality of pin holes 45 to 45N. Platform 34 has first pin 46 in a hole 44 of leg 40 and a second pin 48 in hole 45 of leg 42. Legs 36 and 36A which in this embodiment are hydraulic cylinders having an extension 38 and 38A with a foot 50 and 50A pivotally attached at 52 and 52A respectively. Foot 50 has a hole through which pin 54 may enter into hole 44 of leg 40. Foot 50A has a hole through which pin 54A is inserted to enter hole 45 of leg 42.

Figure 3:
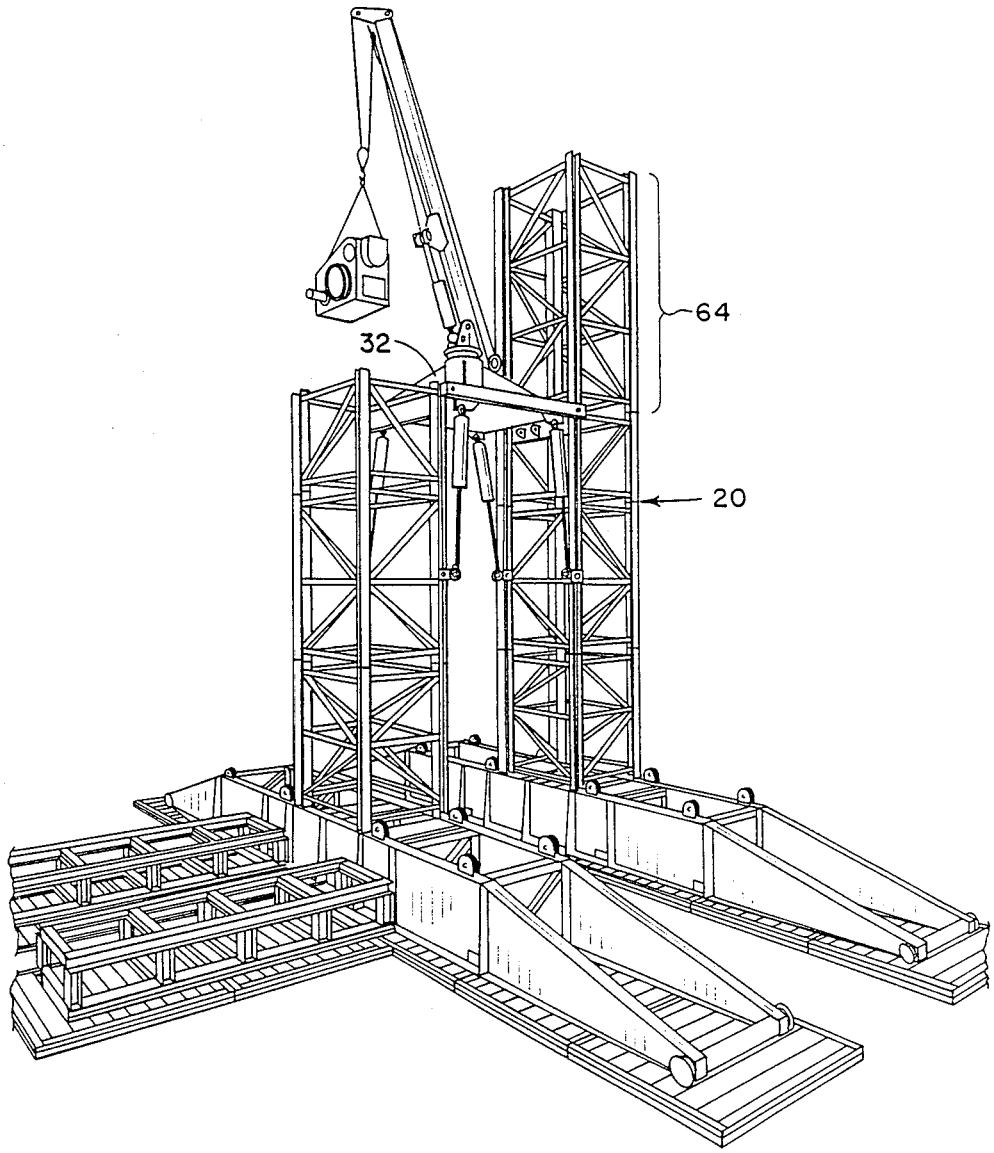
FIG. 3 illustrates an advancement of the erection of structure over that of FIG. 2 and the crane is positioning auxiliary equipment.

When it is desired to move the jacking crane from the position shown in FIG. 2 to the position shown in FIG. 3, the pins 46 and 48 are removed and the jack is held in position by its legs, i.e., cylinder 36 and associated parts including pins 54 and 54A. After the pins 46 and 48 as shown in FIG. 4 are removed, the hydraulic cylinders 36 and 36A are activated and forces the platform upwardly until it reaches the next stage or appropriate pin holes 44 and 45. What I have done is to pin the bottom pins and release the top pins and force the platform 34 upwardly. When it is raised to the proper level I insert the upper pins 46 and 48, remove the lower pins 54 and 54A, retract extensions 38 and 38A and then replace pins 54 in a higher level in holes 44 and 45 as indicated by the dotted line foot configurations 47 and 47A in FIG. 4. Crane 32 is then ready to lift another column section into place. As shown in Figure 4, a typical way of connecting the column sections is by use of pin holes 56 and 56A which are in the legs of the both sections and then as shown in the column portion 22 pins 58 and 58A are inserted therethrough. A gusset 60 can be provided at the top of each section and matches with the mating gusset 60 of the lower end of the next upper column section. When two additional sections are provided on top of the column portions 22 and 20, the pins 46 and 48 are removed and the cylinders 36 and 36A are actuated to drive the platform to its upper position where it is again pinned to the legs 40 and 42. Then the lower pins are released and moved upwardly. Thus, the crane is "walked" up in the space between the two leg portions 20 and 22 until the device reaches its full height as shown in FIG. 6.

Figure 5:
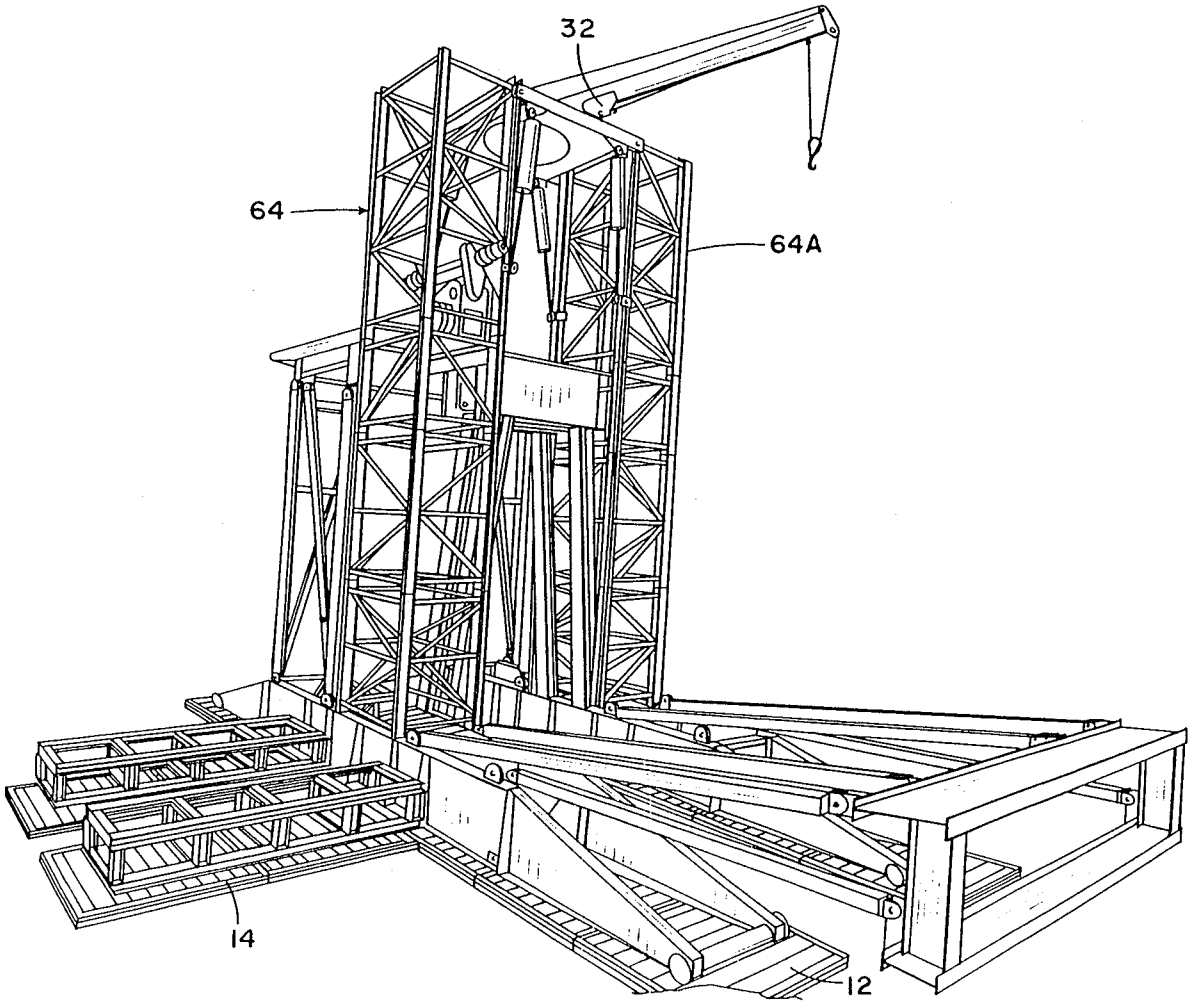
FIG. 5 is similar to FIG. 4 except the left column has been placed in position.

In FIG. 3, Section 64 has been added onto leg portion 20 to extend it upwardly. The crane 32 is lowering a power transmission assembly 33 into place. Attention is next directed to FIG. 5 which shows column section 64A which is the companion to Section 64 has now been placed in position.

Figure 6:
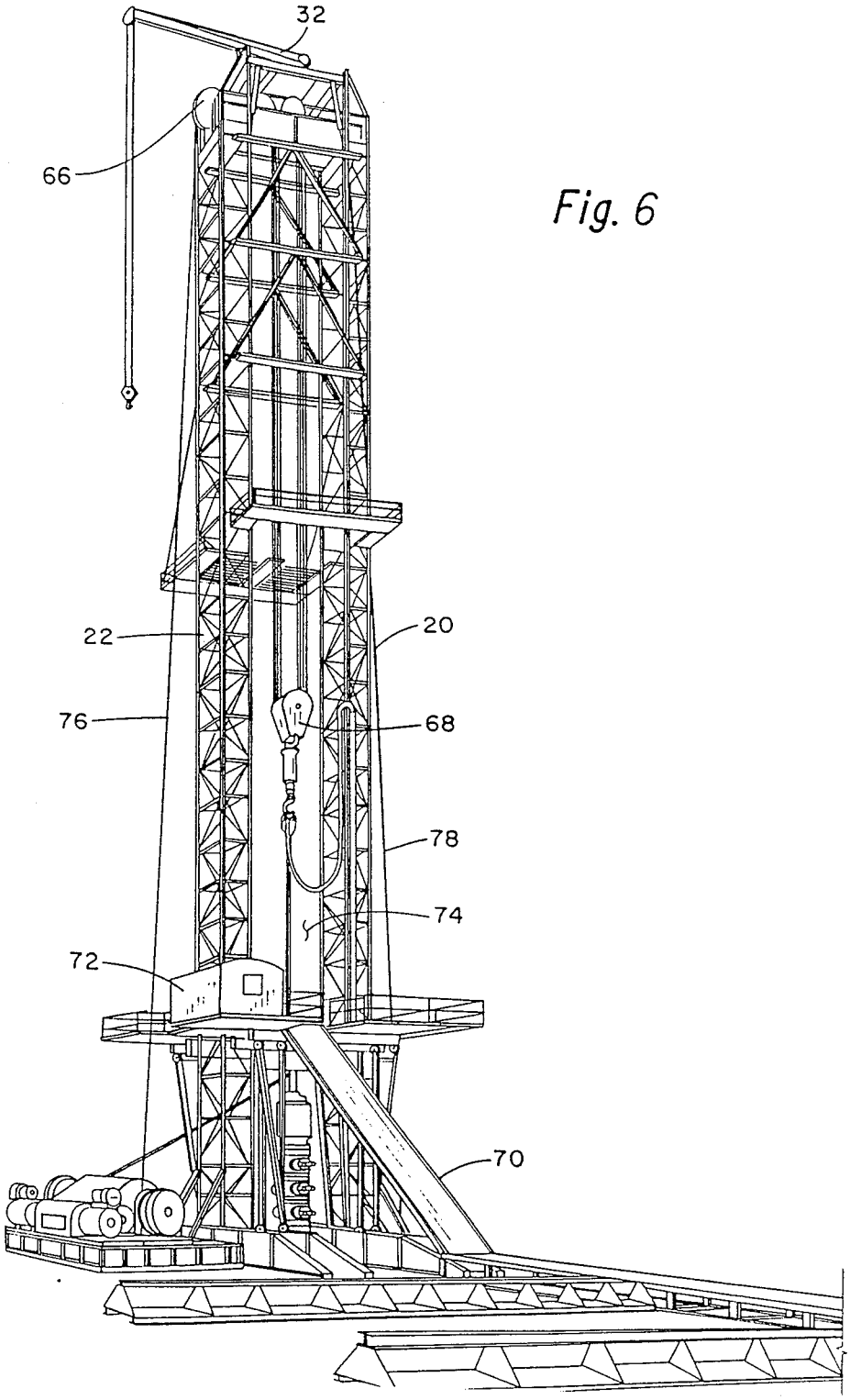
FIG. 6 shows the completed drilling rig.

The crane is continually walked up the space between the columns 20 and 22 and additional column sections added for each step upwardly of the walking crane 32 until the derrick as shown in FIG. 6 is assembled. The crane 32 is at the very top of the derrick and is left there. The crane has been used to assemble or raise the crown block assembly 66 with the travelling block 68. The crane will perform what other services may be necessary. The structure also includes a V-door ramp 70, a dog house or floor office 72 and a V-door 74. This also includes a live line 76 and a dead line 78. The load supporting columns 20 and 22 are truely parallel from the ground level to the top. Each column has four legs with each leg sharing ⅛ of the total load.

The derrick of FIG. 6 is then used to drill a well or hole in the earth. The structure can be made very strong and very high. For example, it can be made 220' or more in height. It is not subject to the height limitation that the mast type derricks are which are rotated from an inclined position to a vertical position. The reclined position gives practical limitations to the length of the prior rig or the height to which it can be extended. Inasmuch as these legs of the present invention are all made of similar section, each leg should share the ⅛ of the total load, that is, when we have two four legged units.

The structure can be covered with a metal skin from top to bottom allowing year round operation without loss of efficiency due to weather conditions. Also, two swinging doors which may be approximately 6' feet and 90' tall can be provided on the V-door side.

After the drilling operations have all been completed, then the derrick assembly of FIG. 6 can be disassembled using the reverse procedure of what has been described above in regard to building it. The crane 32 will be walked down the legs with the column sections removed and lowered to the ground by the crane as it comes to the bottom.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of erecting a drilling derrick from a plurality of column sections, each section having four parallel legs of equal length and rigidly held together by bracing using a jacking crane having a platform and a plurality of hydraulic cylinders with extension rods having feet which comprises:

(a) providing a substructure;

(b) attaching a first column section to said subsection;

(c) attaching a second column section to said subsection at a position thereon such that said first and second columns are spaced apart and are parallel;

(d) securing two feet of said jacking crane to said first section and attaching another two legs of said jacking crane to said second section;

(e) lifting a third section by said jacking crane to the top of said first section and attaching the two together;

(f) lifting a fourth section by said jacking crane to the top of said second section and attaching the two together;

(g) jacking said jacking crane upward by extending said piston extensions;

(h) attaching the jacking crane platform to the top of said third and fourth sections;

(i) detaching said feet from said first and said second sections;

(j) detracting said piston extensions and attaching said first two feet to said third section and said second two feet to said fourth section;

(k) repeating steps (a) through (j) until the two columns have reached their selected height;

retaining said jacking crane at the top of said columns.

2. A method as defined in claim 1 including the step of providing a load bearing beam across the top of said two columns.

3. A method of erecting a drilling derrick comprising:

(a) providing a substructure;

(b) obtaining a plurality of identical column sections, each section having four parallel legs of equal length and rigidly held together by bracing;

(c) attaching a first column section to said subsection;

(d) attaching a second column section to said subsection and in parallel relationship therewith;

(e) supporting a jacking crane from said first and second column section, said crane having a platform and a plurality of piston extensions having feet;

(f) using said jacking crane to add a third and fourth column section respectively to the top of said first and second column sections;

(g) attaching a first group of feet of two said piston extensions to said first section and a second group of feet of said piston extension to said second column section;

(h) then raising the crane platform to approximately the top of said third and fourth section and securing the same thereto;

(i) releasing the feet from the first and second section and retracting the piston extensions;

(j) attaching the first group of feet to said second section and said second group of feet to said third section;

(k) using said crane to place a fifth and sixth section on top of said third and fourth sections respectively and securing the sections together;

(l) continuing the addition of column sections using the jacking crane as set forth above until the desired height of the drilling derrick is obtained.

4. A method as defined in claim 3 including using said crane to dismantle said derrick.

5. A method of erecting a drilling derrick from a plurality of column sections using a jacking crane having a platform and a plurality of hydraulic cylinders which comprises:

providing a substructure;

attaching a first column section to said subsection;

attaching a second column section to said subsection in a spaced apart parallel relationship;

supporting said jacking crane between said first and second column sections;

using said jacking crane to lift a third and a fourth column section respectively on top of said first and second column sections, lifting said crane upwardly in the space between said column sections; upwardly in the space between said column sections;

adding additional column sections to said partially completed columns by using said crane;

repeatedly moving said crane upwardly in the space between said partially completed columns and adding additional column sections at each step until the derrickis completely assembled.

6. A method as defined in claim 5 in which said crane is moved downwardly in steps between said columns and at each step removing a column section from each side of said space.

* * * * *